US005520536A

United States Patent [19]

Rodgers et al.

[11] Patent Number: 5,520,536

[45] Date of Patent: May 28, 1996

[54] PREMIXED GAS BURNER

[75] Inventors: Ian M. Rodgers, Chattanooga, Tenn.; Kelso M. Long, Trenton, Ga.

[73] Assignee: Burner Systems International, Inc., Chattanooga, Tenn.

[21] Appl. No.: 435,733

[22] Filed: May 5, 1995

[51] Int. Cl.[6] ..... F23D 14/14

[52] U.S. Cl. ..... 431/329; 431/326; 431/170; 431/353; 126/116 R; 126/92 AC

[58] Field of Search ..... 431/329, 353, 431/350, 352, 354, 351, 7, 170, 326; 126/116 R, 92 C, 92 AC

[56] References Cited

U.S. PATENT DOCUMENTS

| | | | |
|---|---|---|---|
| 4,599,066 | 7/1986 | Granberg | 431/329 |
| 4,631,023 | 12/1986 | Courrege | 431/329 |
| 4,846,716 | 7/1989 | Courrege | 431/329 X |
| 4,878,837 | 11/1989 | Otto | 431/328 |
| 5,165,887 | 11/1992 | Ahmady | 431/329 |
| 5,222,474 | 6/1993 | Yencha, III | 126/21 A |
| 5,240,411 | 8/1993 | Abalos | 431/329 |
| 5,458,484 | 10/1995 | Ripka | 431/353 |

*Primary Examiner*—Larry Jones
*Attorney, Agent, or Firm*—Alan Ruderman

[57] ABSTRACT

A premixed gas burner has a hollow body including a closed end and an entry end into which a combustible gas and air mixture may flow. The body has a multiplicity of apertures through which the mixture may pass from the hollow interior. A burner portal deck is positioned in superposed relationship over the apertures for permitting the gas air mixture to form a controlled flame. A porous woven fabric formed from ceramic fiber having high thermal insulation properties is located above the deck and separates the deck from the flame front formed when the mixture is ignited. The fabric insulates the deck from excessive temperatures, prevents flash back, allows use of conventional stainless steel for the deck and body components and makes possible the manufacture of long burner sections. A long burner section has a number of decks in side-by-side relationship with an insulating fabric mat over the decks for not only providing insulation, but also forms a gasket between the adjacent decks.

15 Claims, 4 Drawing Sheets

PREMIXED GAS BURNER

BACKGROUND OF THE INVENTION

This invention relates to a premixed gas combustion burner, and more particularly to a burner system which is capable of a high degree of modulation and has the high mechanical strength of a metal burner with the thermal stability of a ceramic burner.

Premixed gas burners used in boilers, heat pumps, hot water heaters and other applications provide a high heat release in a small area while providing low pollutant gas combustion product emissions. Generally such premixed gas burners comprise a hollow body having a closed end and an open end into which the premixed gas flows. The burner body includes at least a portion which has a multiplicity of holes through and out which the gas and air mixture from the interior of the body flows. Another member which has the burner flame port perforations, and which in the case of cylindrical burners such as that disclosed in Canadian Patent No. 1,303,958, may be a coaxial shell, or in certain designs may be a substantially planar member known as a deck, is spaced outwardly or downstream from the body of the burner. In the prior art, no effective insulation has been provided between the outlet of the flame port perforations and the combustible mixture within the body.

Premixed gas combustion flames are short with the flame front just beyond or above the burner port or deck surface. Normally the mixture has approximately 30 percent excess air so as to provide cleaner combustion products. At loadings, i.e., heat per unit area, below approximately 6 kilowatts per square decimeter, the burner port surface will be radiant since the velocity of the mixture is low resulting in the flame being positioned on or closely adjacent to the surface. This gives rise to problems of thermal fatigue and high temperature oxidation of the burner port surface or deck, and potential flashback of the flame into the burner body. At higher loadings, e.g. approximately 12 kilowatts per square decimeter and above, the increase in volumetric flow is such that the velocity of the mixture may be increased to the point where the flame front is further from the burner port surface resulting in a blue flame and the surface of the burner ports material is relatively cool so that a burner port surface material comprising stainless steel may be used without insulation. However, even at such higher loadings if the amount of excess air is not or cannot be controlled resulting in inadequate excess air, burner surface overheating may yet result. In certain applications, such as domestic hot water heaters, high loading is desired. In other applications, however, modulation between high and low loadings are desired. The low burner loadings, however, as aforesaid, result in the burner port surface or deck becoming radiant.

Certain of the aforesaid problems have been addressed by the use of a high temperature grade of stainless steel, or more exotic high temperature materials such as Aluchrome, Haynes 230 and other expensive exotic materials. While such materials may withstand high temperature oxidation, and possibly also degradation due to thermal stresses if the assembly permits expansion and is therefore forgiving, the potential for flashback of the combustible mixture is greatly increased since such metals are excellent conductors of heat. Thus, the temperature on the upstream side of the burner port surface may be substantially the same as that on the downstream side, i.e., the temperature beneath a deck may be the same as the temperature on top of the deck. In that case, the temperature of the gas mixture may be raised toward the auto-ignition temperature before the mixture passes through the burner ports.

A known premixed burner devised to overcome these problems utilizes a metal fiber material formed from an alloy of iron, chromium, aluminum and yittrium applied to the burner port surface or burner deck. The metal fiber material must have a port construction identical to that of the deck. Thus, to produce this structure both the metal fiber structure and the deck, which is constructed from stainless steel, must be perforated simultaneously. The metal fiber product provides an insulating feature due to the porosity of the structure. When perforating the metal fiber material simultaneously with the stainless steel deck, the fibers tend to be compressed and the porosity of the structure is reduced. Consequently, the conductivity of the material is increased and the protection is reduced or lost. Problems in producing this system include maintaining the stainless steel deck and the metal fiber perforations aligned, and a tendency to intermittently attach the metal fibers to the burner deck by cold welding in the ports. In operation, the metal fiber structure is prone to erosion due to the slightly acidic nature of the water vapor in the combustion products. Additionally, the maximum safe operating temperature of this material is very close to the actual operating temperatures of the burners in practice, especially when propane gas is used as the fuel. Another difficulty with the use of metal fibers is that it relies on the formation of a protective aluminum oxide coating, and the coating may not properly form or may even break down if the appliance within which the burner is used is operated incorrectly, such as in a reducing atmosphere.

SUMMARY OF THE INVENTION

Consequently, it is primary object of the present invention to provide a premixed gas combustion burner having the mechanical strength of a metal burner with the thermal stability of a ceramic burner.

It is another object of the present invention to provide a premixed gas burner having a thermal insulator disposed for lowering the temperature of the burner port surface thereby to minimize the potential for flashback of the combustible mixture.

It is a further object of the present invention to provide a premixed gas burner having a thermal insulator in the form of a porous fabric formed from fibers having high thermal insulation properties disposed on the downstream surface of the burner port deck, the flame front being on the downstream side of the fabric for limiting transfer of heat from the flame front back to the deck so that a high degree of heat load modulation may occur without encountering thermal fatigue and high temperature oxidation of the deck or flashback of the combustible mixture within the body of the burner.

It is a still further object of the present invention to provide a premixed gas burner having a thermal insulator in the form of a porous ceramic fiber fabric readily disposed on the downstream surface of the burner port deck which does not corrode as a result of components of the combustion products nor break down in operation, and which limits the transfer of heat back to the deck.

Accordingly, the present invention provides a premixed gas burner having a hollow body including a closed end and an entry end into which a combustible gas mixture is directed, the body having apertures through which the gas mixture is distributed, a burner port deck being positioned in superposed relationship relative to the apertures for throttling the gas mixture to provide a flame front when the mixture is ignited, and the burner having a porous fabric formed from fiber with high thermal insulation properties disposed on the downstream side of the deck to separate the deck from the flame front and insulate the deck from excessive temperatures, and thus prevent flashback, allow the use of inexpensive ferritic stainless steel and make possible the manufacture of long burner sections.

In the preferred form of the invention the fibers from which the fabric is constructed comprise ceramic fiber, which is substantially chemically inert, and therefore is not susceptible to high temperature corrosion due to the acidity of water which may be present in the combustion products. The fiber fabric is supported and held in contact with the deck by a retention member which applies pressure to the fabric against portions of the deck which do not have the ports so as not to constrict the flow of the combustion products through the deck or fabric. In operation the fabric contacts the deck so the deck and fabric act as a unitary structure.

When used with a long burner the deck may be segmented and with the fabric insulator formed as a continuous member, the fabric not only acts as an insulator but also as a gasket between the segmented sections of the deck.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 2:
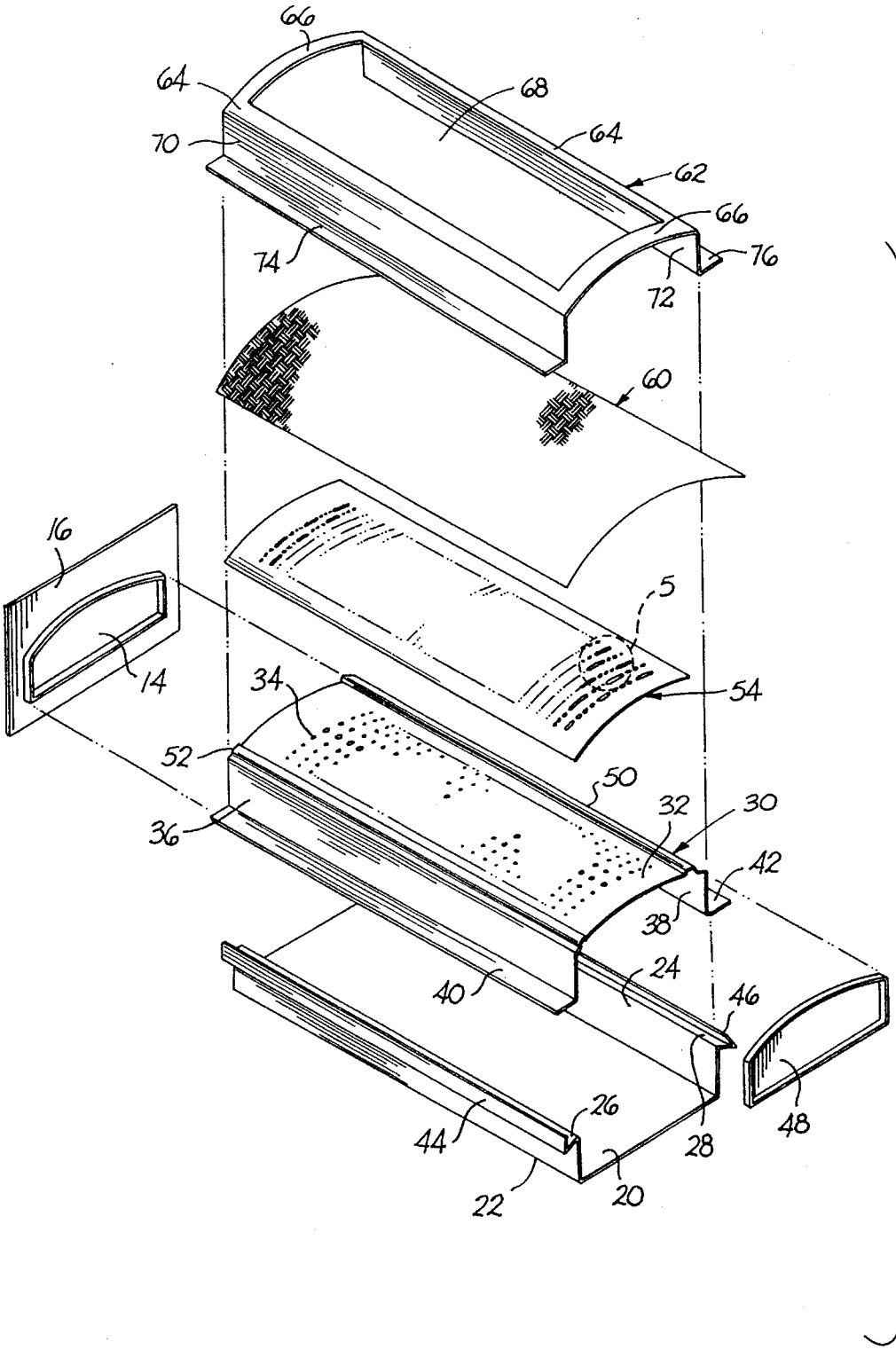
FIG. 2 is a disassembled perspective view of the burner illustrated in FIG. 1.

Referring to the drawings, a premixed gas burner 10 constructed in accordance with the principles of the present invention comprises a hollow body 12 through which a premixed combustible gas mixture may flow, the body having an inlet 14, illustrated in FIG. 2, preferably disposed within a flange 16 adapted to be fastened to an appliance in which the burner is used. The body 12, as in the preferred embodiment, may be an elongated structure comprising a base 18 in the form of a trough having a central wall 20 and a pair of substantially parallel side wall 22, 24 extending outwardly from the wall 20 and terminating at lips 26, 28 extending outwardly from the respective wall 22, 24. Disposed over the base 18 is a distributor member 30 having a wall 32 overlaying the wall 20 of the base 18, the wall 32 of the distributor having a multiplicity of perforations or holes 34 through which the gas mixture may exit from within the hollow of the body 12. The distributor member 30 also includes a pair of side walls 36, 38 extending therefrom which side walls terminate at lips 40, 42 adapted to abut the lips 26, 28 respectively of the base. A flange 44, 46 on the end of each lip 26, 28 of the base may be folded onto the lips 40, 42 respectively and clinched or spot welded thereto to unify the body 12 with an end closure cap 48 therebetween at the end remote from the inlet 14, the cap 48 and flange 16 about the opening 14 being welded to the distributor member and body. Thus, a hollow burner having an inlet through which combustible gas may enter and having exit openings 34 through which the gas may egress is provided.

Figure 1:
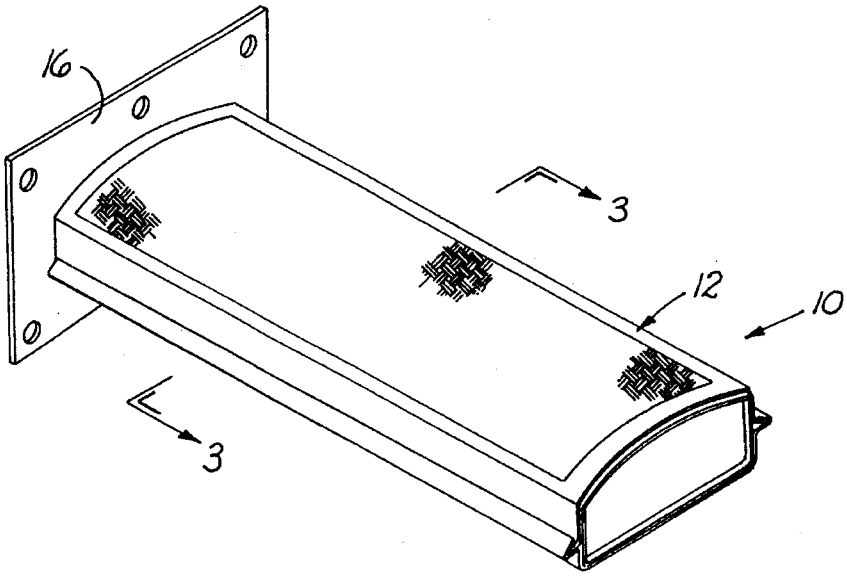
FIG. 1 is a perspective view of a premixed gas burner constructed an accordance with the principles of the present invention.
Figure 3:
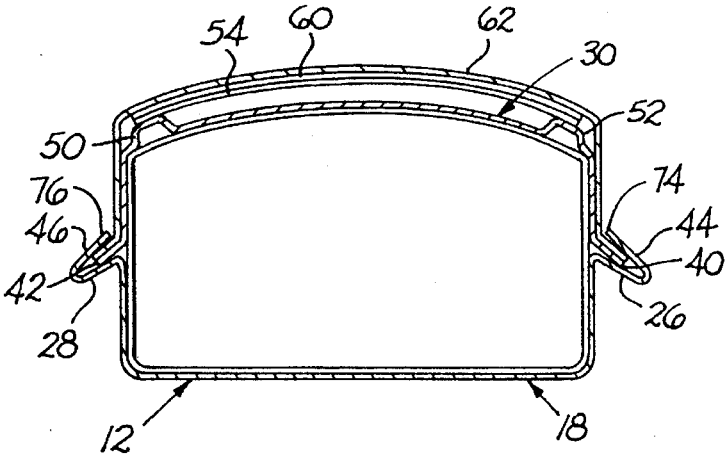
FIG. 3 is a cross sectional view taken substantially along line 3—3 of FIG. 1.
Figure 4:
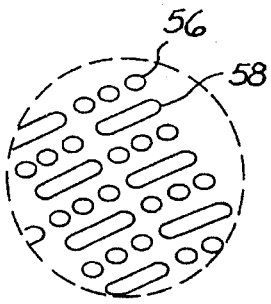
FIG. 4 is an enlarged view of a fragmentary portion of the burner deck as illustrated in FIG. 2.

Disposed on ridges 50, 52 outstanding from the outer surface of the wall 32 is a peripheral portion of the burner deck 54. The deck 54 is highly perforated with the burner ports which preferably may include circular openings 56 and elongated slots 58 substantially equal in length to three openings as illustrated in FIG. 4, the ports being located in an array disposed within a substantially central area of the deck spaced from the periphery and superposed over the perforations 34 in the wall 32 of the distributor 30. Thus, the combustible gas mixture exiting the perforations 34 flows through the openings 56, 58 and may be ignited.

Disposed on the surface of the burner deck 54 remote from the distributor 30, i.e., the downstream surface of the burner deck in relation to the direction in which the gases flow, is a fabric cloth or mat 60 woven from fibers of thermal insulation material such as ceramic fibers. The ceramic fibers preferably may comprise 62% $Al_2O_3$, 24% $SiO_2$ and 14% $B_2O_3$ with a fiber density of approximately 2.7 gm/cc and a diameter of 10 to 12 micron. A cloth or mat woven from fiberglass fibers may also have the required thermal insulation properties. A retainer 62 in the form of a frame having opposed side and end rails 64, 66 respectively disposed about a central opening 68 substantially of a size and configuration as that of the portion of the burner deck having the array of ports 56, 58 is located on the downstream surface of the fabric 60 to retain it tightly against the surface of the deck 52 outwardly of the ports 56, 58. The retainer 62 includes a pair of depending legs 70, 72 which overlay and abut the side walls 36, 38 of the distributor 30 and preferably includes lips 74, 76 which may be disposed between the lips 40, 42 of the distributor 30 and the flanges 44, 46 of the base 18 and be clinched or welded thereto. Additionally, the ends of the rails 66 may be clinched or welded to the end cap 48 and the flange 16 so that the retainer is secured to the body of the burner and retains the fabric 60 against the deck 54.

In operation, premixed gas and air enter through the inlet 14 of the flange 16 under pressure created by a blower or the like (not illustrated)fin the appliance in which the burner is mounted. The mixture is disbursed evenly throughout the burner by the perforated baffle created by the wall 32 of the distributor 30 which creates a high pressure drop and is closely spaced, e.g. approximately 2.5 mm, from the burner deck 54. The mixture then passes through the burner deck ports 56, 58 and through the fabric 60 which, because of the close proximity thereof created by the clamping action of the retainer 62, act as a single member. The mixture may be ignited to burn above the burner deck and ceramic fabric combination. The ceramic fibers have a very low thermal expansion coefficient, approximately $3\times10^{-6}$ per deg. C. and, therefore, the stainless steel deck beneath the fabric when it expands, abuts the ceramic fabric which remains relatively stationary. The fabric and the stainless steel deck thereby act as a unitary member.

When the loading of the burner is reduced below about 10 kilowatts per square decimeter the surface of the ceramic fabric 60 becomes radiant. Because of the low thermal conductivity and porous nature of the woven ceramic fabric, the temperature on the underside of the fabric is substantially lower than the temperature on the upper surface. Thus, the temperature on the burner deck is kept well below the auto-ignition temperature of the gas/air mixture. The temperature differential between the upper surface of the ceramic mat and the lower surface of the ceramic mat may be approximately 400° C. when the upper surface is in the range of 750° C. to 950° C. The temperature, even under worst case conditions, on the burner deck is generally maintained below 500° C. The burner deck/ceramic fabric combination is extremely stable even at high excess air factors of about 60% excess air and loadings 15 kilowatts per square decimeter because part of the mixture tends to burn in the ceramic fabric causing small radiant sections throughout the burner surface.

Figure 5:
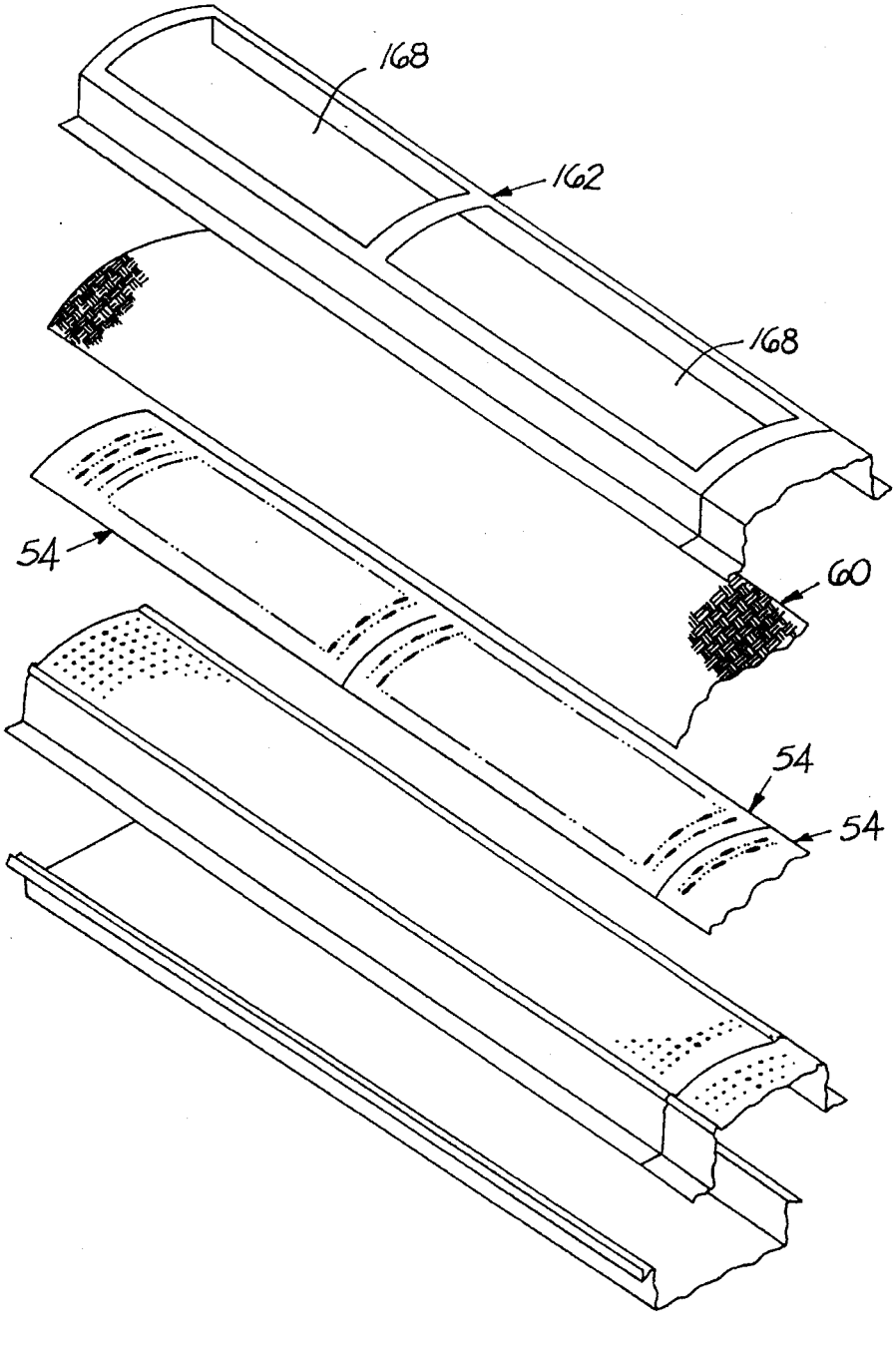
FIG. 5 is a view similar to FIG. 2 but illustrating a long burner with a segmented deck.

When constructing a long burner, the burner deck, as illustrated in FIG. 5, may be segmented or formed from a number of the burner decks 54 and allowed to float lengthwise when expansion occurs. The ceramic fabric 60, however, as illustrated in FIG. 5, is a continuous mat which acts as a gasket between the segmented burner deck pieces. The retainer in this case is an elongated structure 162 having a plurality of central openings 168 each corresponding to one of the burner decks 54. Such long burners may be required in some applications, for example, in steam boilers for commercial applications. In such case a burner of approximately five feet may be required. Since the decks are fabricated from stainless steel which has a high coefficient of thermal expansion, the deck is segmented into sections of approximately ten inches. However, the mixture normally can flow through the gap between the segments which would result in an uncontrolled and noisy flame. The ceramic fiber fabric thus acts as a seal or gasket in addition to insulator in this embodiment and prevents the gases from forming the uncontrolled flame.

Figure 6:
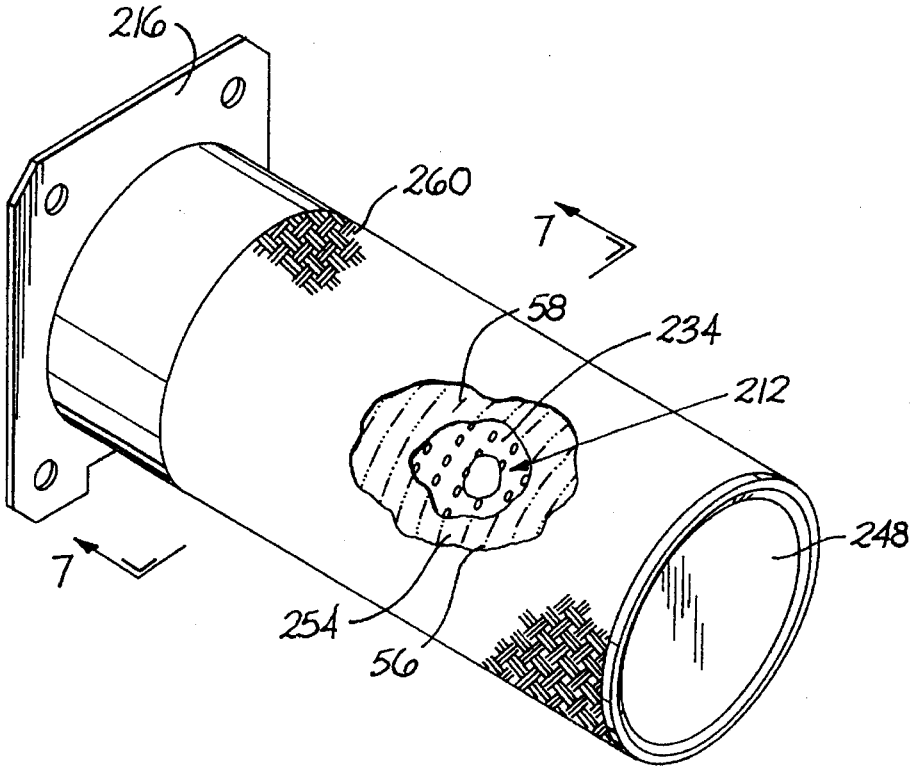
FIG. 6 is a perspective view of a cylindrical premixed gas burner constructed in accordance with the present invention.
Figure 7:
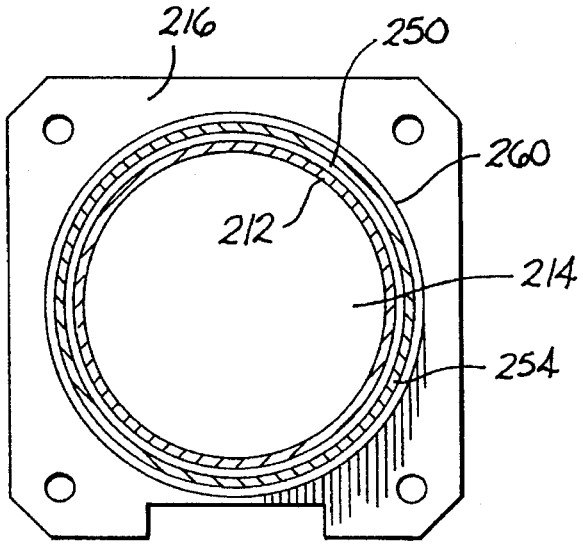
FIG. 7 is a cross sectional view taken substantially along line 7—7 of FIG. 6

Referring to FIGS. 6 and 7, a cylindrical premixed gas burner is illustrated having a body 212, which may receive premixed gas and air through an inlet 214 at one end of the body opening into an entrance in a mounting flange 216. An end cap 248 opposite to the inlet 214 acts as a closure member to close the body which includes a multiplicity of holes 234 through which the mixture may egress and be distributed. A burner deck 254 is spaced radially outwardly from the body 212 by means of annular ribs 250 (only one of which is shown) at each end of the body, the deck 254 having the ports which preferably include circular openings 56 and elongated slots 58 such as that illustrated in FIG. 4 in regard to the earlier embodiments. An insulating mat 260, formed from an insulating material as heretofore described, in the form of a cylindrical sleeve, is positioned about the deck 254. The sleeve 260 is retained tightly against the outer surface of the deck 254 by an interference fit provided by radially inwardly compressing the outer periphery of the deck 254, positioning the sleeve about the deck and thereafter permitting the deck to spring outwardly to retain the sleeve tightly against the deck. In all other respects this embodiment is substantially identical to those heretofore described.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A premixed gas burner comprising, a hollow body member having an inlet for receiving a combustible mixture of gas and air and outlet means, said outlet means comprising an outlet area of said body member having a multiplicity of apertures through which said mixture may flow, a burner portal deck having first and second surfaces disposed with said first surface in close proximity to said outlet area, said deck having a multiplicity of burner ports extending through said surfaces and disposed in an array superposed over said apertures for permitting said gas and air mixture received from said body member to flow from said first surface to said second surface, a thermal insulator in the form of a porous woven fabric mat disposed on said second surface of said deck permitting said gas and air mixture to flow therethrough and to be ignited to form a flame front at said second surface while limiting transfer of heat from said flame front to said deck, and retaining means for holding said fabric against said second surface of said deck.

2. A premixed gas burner as recited in claim 1, wherein said fabric mat comprises fibers having high thermal insulating properties.

3. A premixed gas burner as recited in claim 2, wherein said fibers comprise ceramic material.

4. A premixed gas burner as recited in claim 1, wherein said retainer means comprises a frame disposed in abutment with and secured to said body member, said frame having rails abutting portions of said mat and having a central opening disposed in superposed relationship over said array of ports.

5. A premixed gas burner as recited in claim 4, wherein said fabric mat comprises fibers having high thermal insulating properties.

6. A premixed gas burner as recited in claim 5, wherein said fibers comprise ceramic material.

7. A premixed gas burner as recited in claim 1, wherein said body member and deck are cylindrical members, and said mat is a cylindrical sleeve.

8. A premixed gas burner as recited in claim 7, wherein said fabric mat comprises fibers having high thermal insulating properties.

9. A premixed gas burner as recited in claim 8, wherein said fibers comprise ceramic material.

10. A premixed gas burner comprising an elongated hollow body member having an inlet for receiving a combustible mixture of gas and air and outlet means, said outlet means comprising an outlet area of said body member having a multiplicity of apertures through which said mixture may flow, a plurality of burner portal decks each having first and second surfaces disposed in side-by-side relationship with said first surfaces in close proximity to respective adjacent portions of said outlet area, each of said decks having a multiplicity of burner ports extending through said first and second surfaces and disposed in an array superposed over apertures in said respective portions of said outlet area for permitting said gas and air mixture received from said body member to flow from said first surface to said second surface of each deck, a thermal insulator in the form of an elongated porous woven mat disposed on said second surface of all of said decks permitting said gas and air mixture to flow therethrough and to be ignited to form a flame front at said second surfaces while limiting transfer of heat from said flame front to said decks, and retainer means for clamping said fabric against said second surfaces of said decks.

11. A premixed gas burner as recited in claim 10, wherein said fabric mat comprises fibers having high thermal insulating properties.

12. A premixed gas burner as recited in claim 11, wherein said fibers comprise ceramic material.

13. A premixed gas burner as recited in claim 10, wherein said retainer means comprises a frame disposed in abutment with and secured to said body member, said frame having rails abutting portions of said mat and having a plurality of openings corresponding in number to the number of decks, each opening disposed in superposed relationship over and array of burner ports of a respective deck.

14. A premixed gas burner as recited in claim 13, wherein said fabric mat comprises fibers having high thermal insulting properties.

15. A premixed gas burner as recited in claim 14, wherein said fibers comprise ceramic material.

* * * * *